US007571832B2

(12) United States Patent
Mark et al.

(10) Patent No.: US 7,571,832 B2
(45) Date of Patent: Aug. 11, 2009

(54) PACK OF INTERFOLDED TISSUES WITH ENHANCED DISPENSING

(75) Inventors: Erwin Paul Mark, Bad Soden (DE); Daniel Yugueros Tarrasón, Barcelona (ES)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 11/521,004

(22) Filed: Sep. 14, 2006

(65) Prior Publication Data

US 2007/0062968 A1 Mar. 22, 2007

Related U.S. Application Data

(63) Continuation-in-part of application No. 11/515,281, filed on Sep. 1, 2006.

(60) Provisional application No. 60/718,030, filed on Sep. 16, 2005.

(30) Foreign Application Priority Data

Jul. 26, 2006 (EP) ..... 06117870

(51) Int. Cl.
*B65H 45/24* (2006.01)
*A47K 10/24* (2006.01)

(52) U.S. Cl. ..... 221/48; 221/47; 221/33; 221/63

(58) Field of Classification Search ..... 221/1–312 C
See application file for complete search history.

(56) References Cited

U.S. PATENT DOCUMENTS 3,207,360 A * 9/1965 Scott ..... 221/48
4,863,064 A * 9/1989 Dailey, III ..... 221/48
5,516,001 A * 5/1996 Muckenfuhs et al. ..... 221/63
5,520,308 A * 5/1996 Berg et al. ..... 221/50
5,540,332 A * 7/1996 Kopacz et al. ..... 206/494
5,609,269 A * 3/1997 Behnke et al. ..... 221/48
5,642,835 A * 7/1997 Young et al. ..... 221/1
5,964,351 A * 10/1999 Zander ..... 206/494
6,168,848 B1 * 1/2001 Heath ..... 428/126
6,202,845 B1 * 3/2001 Hill ..... 206/449
6,213,344 B1 * 4/2001 Hill ..... 221/38

(Continued)

FOREIGN PATENT DOCUMENTS

EP 1764332 3/2007

*Primary Examiner*—Gene Crawford
*Assistant Examiner*—Michael K Collins
(74) *Attorney, Agent, or Firm*—Peter D. Meyer

(57) ABSTRACT

A pack of tissues includes multiple interfolded tissues arranged in a stack and an external envelope enclosing the stack. The external envelope includes a dispensing orifice and the tissues are folded so as to include a leading panel, an optional central panel, a trailing panel, a leading fold and an optional trailing fold, wherein the leading fold separates the leading panel from the central panel and the optional trailing fold separates the optional central panel from the trailing panel. The stack has a first tissue and an second tissue, the second tissue being positioned next to the first tissue in the stack and further away in the stack from said dispensing orifice. The tissues are interfolded so as to have an overlapping portion of the first tissue under a portion of the second tissue. The surface area of the overlapping portions is not constant throughout the stack; preferably it increases with the distance to the dispensing orifice.

15 Claims, 10 Drawing Sheets

U.S. PATENT DOCUMENTS 6,286,712 B1 * 9/2001 Craig et al. ..... 221/48
6,543,643 B2 * 4/2003 Iida et al. ..... 221/48
6,550,634 B1 * 4/2003 Alegre De Miquel et al. . 221/48
6,595,386 B2 * 7/2003 Vogel et al. ..... 221/48
6,641,894 B2 * 11/2003 Bando ..... 428/126
6,644,501 B2 * 11/2003 Iida ..... 221/48
6,685,050 B2 * 2/2004 Schmidt et al. ..... 221/48
6,960,349 B2 * 11/2005 Shantz et al. ..... 424/402
6,964,349 B2 * 11/2005 Sears et al. ..... 221/48
6,971,542 B2 * 12/2005 Vogel et al. ..... 221/45
7,204,390 B2 * 4/2007 Widlund ..... 221/47
2002/0096533 A1 * 7/2002 Amundson et al. ..... 221/63
2003/0116581 A1 6/2003 Schmidt et al.
2006/0219731 A1 * 10/2006 Long ..... 221/48
2006/0237474 A1 * 10/2006 Long ..... 221/33
2007/0034639 A1 * 2/2007 Zeiron ..... 221/47
2007/0062966 A1 * 3/2007 Mark et al. ..... 221/48

* cited by examiner

PACK OF INTERFOLDED TISSUES WITH ENHANCED DISPENSING

CROSS-REFERENCE TO RELATED APPLICATIONS

This application is a continuation-in-part of U.S. patent application Ser. No. 11/515,281, filed Sep. 1, 2006, which claims the benefit of U.S. provisional application Ser. No. 60/718,030, filed Sep. 16, 2005.

FIELD OF THE INVENTION

The invention relates to the field of dispensing tissues such as wipes out of a pack.

BACKGROUND OF THE INVENTION

Tissues are substantially flat articles commonly used in a wide range of applications: Paper tissues, dry wipes, wet wipes, paper handkerchiefs, paper towels and the like are articles of frequent usage. Tissues are generally provided as stacks of multiple tissues enclosed in an envelope (i.e. a hard container or a flexible pouch): typical examples are packs of paper tissues and packs of wet wipes. A dispensing orifice allows for the tissues to be dispensed individually. Alternatively some tissues are presented in a rolled form.

Using conventional packs of tissues it is known that the users can encounter a variety of problems. For example, the first tissue of the stack can be difficult to reach and to dispense out of the pack, as it "fall-back" inside the pack upon dispensing of the previous tissue. Another example is technically known as "chaining": the dispensing of a tissue provokes the simultaneous and undesired dispensing of one, two or more additional tissues. In the context of wet-tissues, "chaining" can also be linked to undesired dry-out of the stack of wet-tissues, as more material is exposed out of the pack and promotes the evaporation the wetness of the tissues.

Conventionally the size of the dispensing orifice of the pack can be optimized to reduce the frequency of the dispensing failures and/or to authorize a better access to the tissues, i.e. minimization of the consequence of "fall-back" events by using larger dispensing opening allowing the fingers to the users to reach more easily the tissues, or narrower dispensing orifice creating more friction on the tissues during dispensing and hence reducing the occurrence of "chaining".

Also conventionally, some of the issues can be partially solved by interfolding the tissues in the stack so as to have a first tissue of the stack lifting a portion of a second tissue of the stack. This is an improvement versus non interfolded tissues. It remains however that the user dispensing interfolded tissues still experience undesired "fall-back" and "chaining" events at an annoying frequency. The "chaining" problems can be exacerbated when the interfolded tissues comprise a lotion, somewhat sticky, that tends to aggravate the undesired adhesion of the successive tissues in the stack to each other. The "fall-back" problem is also exacerbated when the sack is of a significant height, for example in packs of wet wipes for family usage.

Hence, there is a need to provide a pack of tissues that provides high performance in dispensing the tissues out of the pack.

There is a need to provide a pack of tissues that exhibits low frequency of "chaining" and/or "fall-back" events.

There is a need for a pack of tissues which exposed leading portions are easily gripable by the user. When the tissues are wet-tissues, there is a need for a pack of tissues which exposed leading portions upon dispensing remain sufficiently small to reduce the dry-out of the stack of wet-tissues.

There is a need for a pack of tissues that dispenses out of a pack easily and is conveniently accessible to the user.

There is a need for a pack of tissues that exhibits optimum dispensing performance for different types of tissues, for example by using a "universal" external envelop that can economically be used for dispensing many types of different tissues with high efficiency.

SUMMARY OF THE INVENTION

To improve tissue dispensing, the present invention provides a pack of tissues including multiple tissues arranged in a stack and an external envelope enclosing the stack. The external envelope includes a dispensing orifice. The tissues are folded so as to include a leading panel, a trailing panel, an optional central panel, a leading fold and an optional trailing fold, wherein the leading fold separates the leading panel from the trailing or central panel. The tissues are interfolded such as to have a portion of the trailing or central panel of a preceding tissue to be (i) located under a portion of a succeeding tissue and (ii) in contact with a portion of the succeeding tissue over an overlapping portion. The surface area of the overlapping portion of at least one tissue is different from the surface area of the overlapping portion of at least one other tissue of the stack. Preferably the surface area of the overlapping portion is smallest for the tissues closest (in the pack) to the dispensing orifice and greatest for the tissues further away from the dispensing orifice.

DETAILED DESCRIPTION OF THE INVENTION

Figure 1:
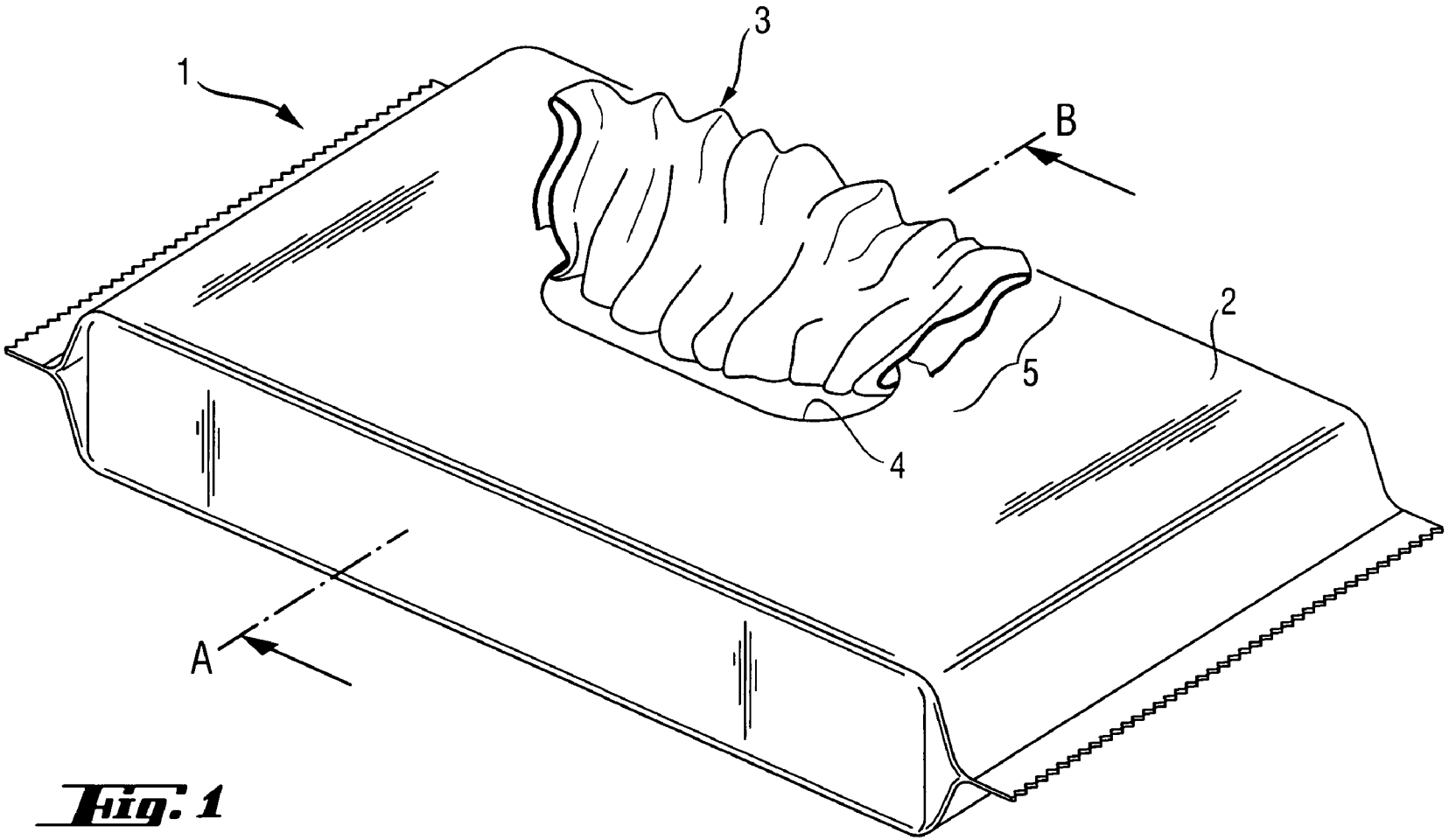
FIG. 1 is a perspective view of a conventional pack of tissues with the exposed leading edge of a tissue protruding from the dispensing orifice.

Generally, tissues are articles comprising a substantially flat substrate. Typical tissues of the present invention include sheets of all sorts, fabric, dry and wet wipes for toilet, cosmetic or cleaning use, paper handkerchiefs, kitchen towels, bath tissue, absorbing tissues of all kinds, paper tissues, combinations thereof, and the like. The substrate of the tissues of the invention is relatively flexible, and in many case relatively soft. The tissue of the invention can be woven or non-woven or partly woven. The substrate of the tissue of the invention can comprise synthetic fibers, natural fibers, fibers derived from natural materials and/or mixtures thereof. Examples of synthetic fibers for the invention include polyethylene, polypropylene, polyamide and polyester fibers. Examples of natural fibers or fibers derived from natural material for the invention include cellulosic fibers of all types, vegetable fibers, wood fibers, pulp, soft and/or hard wood fibers, cotton fibers, wool fibers, Lyocell fibers, viscose and the like. The tissue of the invention can be solely made of cellulosic fibers or alternatively solely made of synthetic fibers. Tissues of the invention can also comprise a mixture of synthetic and natural fibers.

The tissues of the invention can be made by a variety of conventional manufacturing methods. The tissues of the invention can be dry-laid in an air-laid process, meltblown, spun-laced, or spun-bond. Alternatively the tissues of the invention can be made in a wet laid process, preferably in a conventional or through-air dry papermaking process. Processes mixing wet-laying and air-laying are also envisioned for the tissues of the invention. After the substrate of the tissue of the invention is made, the substrate can be converted to produce the tissue of the invention. Converting steps can conventionally include one or more of the steps of cutting, surface-treating, brushing, fibers-adding, lotioning, folding and packing the tissues of the invention.

When the tissues of the invention are wipes, they can be used for cleaning, treating and/or and removing residues from surfaces. The surfaces may include hard surfaces (such as the surface of a piece of furniture or a floor) or soft surfaces, including part of a human body. Certain wipes of the invention include baby, children and adults wipes conventionally used for cleaning skin portions (for example face, uro-genital area, anal area) of adults or children. Yet, other wipes for the invention includes articles for cleaning floors, kitchen surfaces, windows or office surfaces. The wipes are generally impregnated with a composition. The composition conventionally facilitates the removal of residues and/or delivers an active ingredient to the treated surface. The composition is conventionally fluid or semi-fluid at ambient temperature.

The tissues are generally characterized by a width (17) and a length (18). The width (17) of the tissue is conventionally measured edge to edge, transversally to the dispensing direction of the tissue. The length (18) of the tissues is conventionally measured parallel to the dispensing direction of the tissue, edge to edge. Tissues are typically rectangular or quadratic. For most rectangular tissues, the length 18 is greater than the width 17. Tissues of the invention can also be circular, oval, triangular, pentagonal, hexagonal or of any shape suitable for the intended purpose.

Folded tissues: Because tissues are generally larger than the pack from in which they are provided, the tissues are often folded. Some conventional folding configurations create 2 folds and 3 panels (so-called "C-folding and Z-folding"). As shown for example in FIGS. 3, 4, 6 and 7 a leading panel (6, 6*a*, 6*b*) articulates around a leading fold (7) to a central panel (8, 8*a*, 8*b*). The central panel (8, 8*a*, 8*b*) articulates around the trailing fold (9) to a trailing panel (10, 10*a*, 10*b*). More panels and more folds can be provided. In particular the central panel 8, 8*a*, 8*b* can comprise more than one panel and comprise one or more folds. Another conventional folding pattern is shown in FIG. 5 (so-called "V-folding"): the tissue has a leading panel (6*a*, 6*b*), a trailing panel (10*a*, 10*b*) and a leading fold (7*a*, 7*b*), but no central panel.

Conventionally the tissues are folded in a way that divides their length (i.e. the folding lines are transversal to the dispensing direction, parallel to the width of the tissues). The length (18) of the tissue is measured edge to edge, unfolded.

The tissues (3) comprises a leading edge (14) and a trailing edge (15) that are defined in regard to the dispensing direction of the tissue (3): The leading edge (14) is first dispensed when the tissue (3) is pulled out of the external envelop (2). The trailing edge (15) then terminates the dispensing of the tissue.

Stack of tissues: Tissues are conventionally provided in selling units comprising multiple tissues. Tissue numbering such as first, second, "$n^{th}$ tissue" and "$n+1^{th}$ tissue" is used in the present document to refer to the consecutive order of the tissues in the stack. By definition, the first tissue of the stack is the interfolded tissue closest to the dispensing orifice of the pack and the numbering is consecutive. Hence, the second tissue is positioned next to the first tissue in the stack and further away from the dispensing orifice. More generally "$n^{th}$ tissue," or "first tissue" and "$n+1^{th}$ tissue," or "second tissue" are used in the present document to refer to successive tissues in the stack, the $n^{th}$ tissue being closer to the dispensing orifice than the $n+1^{th}$ tissue and the $n+1^{th}$ tissue following in the stack next to the $n^{th}$ tissue. It is understood that n can be an integer having any value between 1 and the number of tissues in the stack (13). Only interfolded tissues are considered in case the stack comprises a mix between interfolded and non interfolded tissues. It is considered that once a first tissue is dispensed, the (former) second tissue becomes the first tissue in the stack.

The tissues are conventionally folded and stacked one over the other to form a stack of tissues (13). Stacks of tissues can be made of interfolded tissues and non-interfolded tissues. The stack of tissues of the invention comprises interfolded tissues. In most interfolded stacks, at least a portion of a $n+1^{th}$ tissue in the stack is located in between portions of two panels of a $n^{th}$ tissue in the stack (13). In most interfolded stacks, a portion of an $n^{th}$ tissue is located under a portion of an $n+1^{th}$ tissue. Consequently, in interfolded stacks, the dispensing of a $n^{th}$ tissue lifts a portion of the $n+1^{th}$ tissue such a to prepare the $n+1^{th}$ tissue for dispensing, preferably by inducing the protrusion of a portion of the $n+1^{th}$ tissue through the dispensing orifice.

Interfolding/overlapping portion: The manner the tissues are interfolded creates an overlap (19) between two consecutive tissues. The tissues for the invention are interfolded such as to have a portion of the trailing panel (10*a*) and/or of the central panel (8*a*) of a $n^{th}$ tissue in the stack to be located under a portion of the $n+1^{th}$ tissue in the stack. This creates an overlapping portion of the $n^{th}$ tissue. The overlapping portion of the $n^{th}$ tissue is defined as the portion of the $n^{th}$ tissue (for example a portion of the trailing or central panel of the $n^{th}$ tissue) that is both (i) located under a portion of the $n+1^{th}$ tissue and (ii) in contact with a portion of the $n+1^{th}$ tissue.

In this document the term "under", in regard to the folding configuration of the tissues (3) in the stack (13), is used in reference to the spatial orientation of the pack (1) and the stack (13) of tissues: The term "under" make reference to the pack (1) of the invention being laid flat on an horizontal surface, the dispensing orifice (4) being located at upper side of the pack (1), and the tissues (3) being stacked below the dispensing orifice (4).

In this document, the term "contact", in regard to the portion of tissues (3), is equivalent to "direct contact", i.e. portions of materials touching each other.

Figure 4:
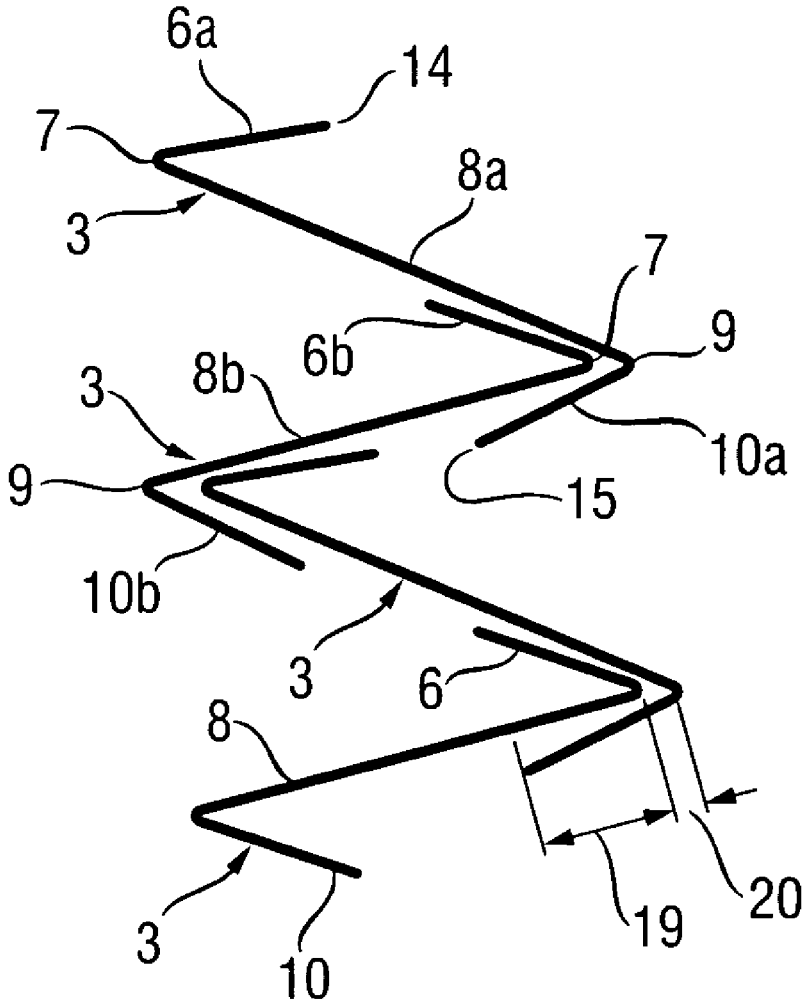
FIG. 4 is a schematic representation of an interfolding configuration of tissues (so-called "Z fold"), applicable for the present invention.
Figure 5:
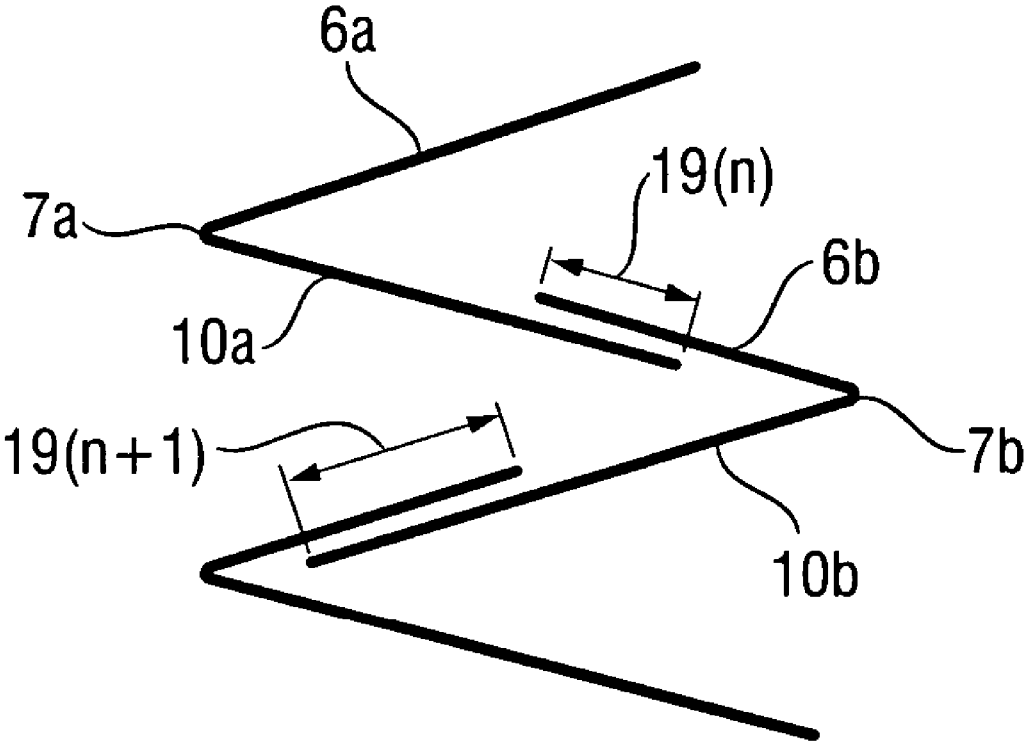
FIG. 5 is a schematic representation of an interfolding configuration of tissues (so-called "V-fold"), applicable for the present invention.

As a typical interfolding configuration, FIG. 4 shows a portion of the central panel (8*b*) and of the leading panel (6*b*) of the second tissue in the stack being located in between a portion of the central panel (8*a*) and of the trailing panel (10*a*) of the first tissue in the stack. A portion of the trailing panel (10*a*) is hence both (i) located under a portion of the central panel of the second tissue and (ii) in contact with a portion of the central panel of the second tissues.

Figure 6:
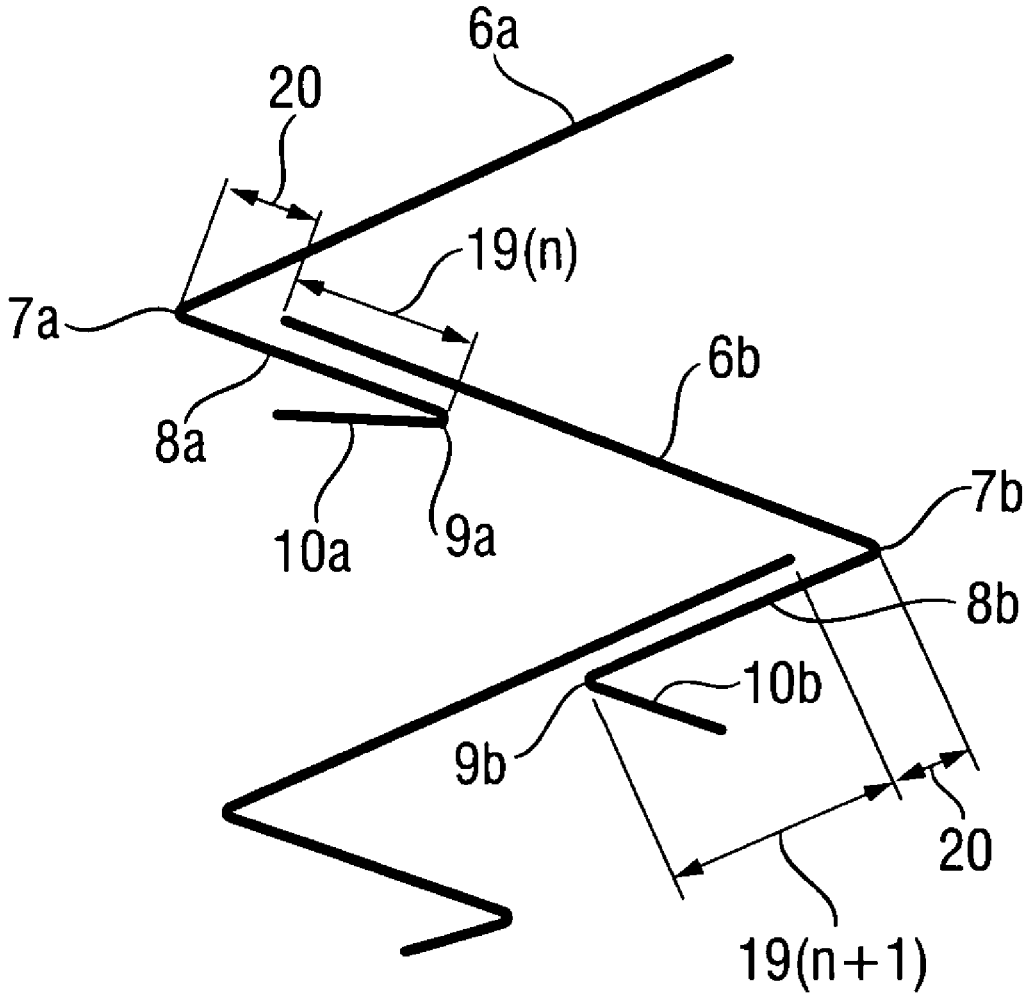
FIG. 6 is a schematic representation of an interfolding configuration of tissues (so-called "long Z-fold"), applicable for the present invention.
Figure 7:
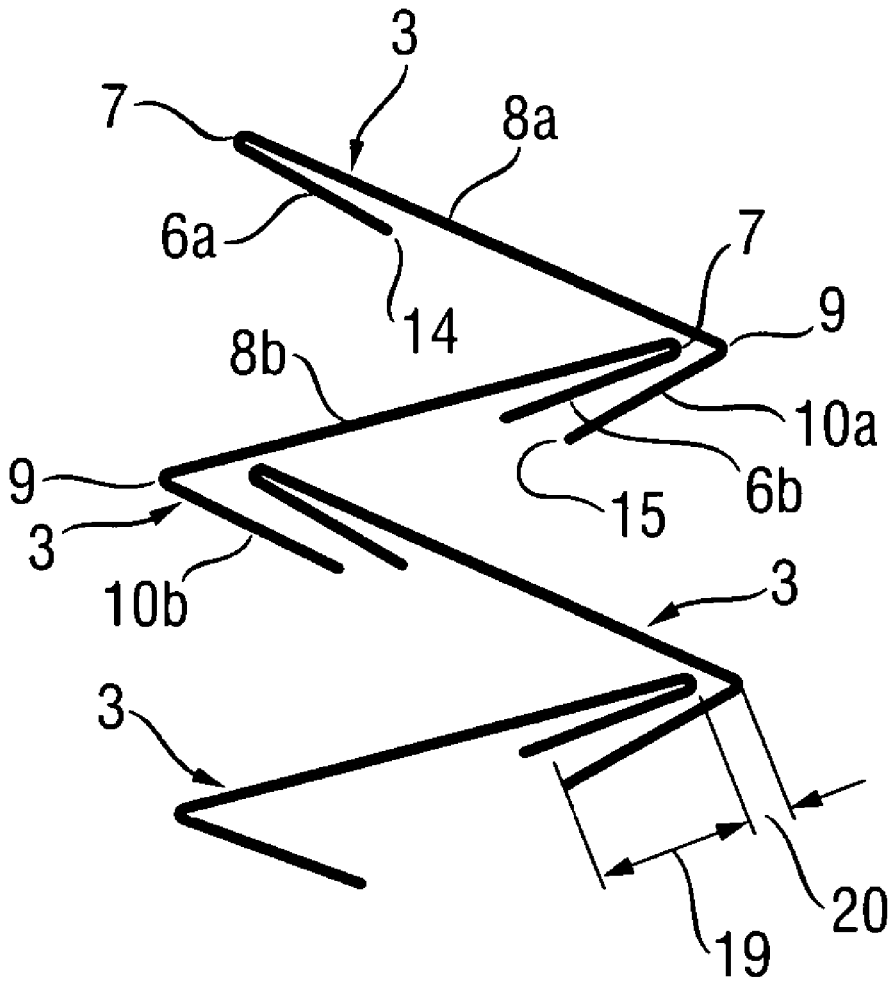
FIG. 7 is a schematic representation of an interfolding configuration of tissues (so-called "C-fold"), applicable for the present invention.

Other typical interfolding configurations applicable to the present invention are shown in FIGS. 5, 6 and 7. FIG. 5 shows a so-called V-folding of interfolded tissues. Overlapping portions of the leading panels are shown (19(n) and 19(n+1)). According to one embodiment of the invention, the length of the overlapping portion (19(n+1)) of the leading panel of the $n+1^{th}$ tissue is greater than the length of the overlapping portion (19(n)) of the leading panel of the $n^{th}$ tissue. FIG. 6 another typical Z-folding of interfolded tissues (so-called "long Z-folding"). Here also, according to one embodiment of the invention, the length of the overlapping portion (19(n+1)) of the leading panel of the $n+1^{th}$ tissue is greater than the length of the overlapping portion (19(n)) of the leading panel of the $n^{th}$ tissue. FIG. 7 shows a typical C-folding configuration of interfolded tissues. The trailing panel (10*a*) of the $n^{th}$ tissue is located under and contacts the trailing panel of the $n+1^{th}$ tissue.

Typically, a corner gap (20) may be created when the leading/trailing folds of two consecutive tissues do not touch each other. Typically the dimension of the corner gap (20) added to the dimension of the overlapping portion (19) of the $n^{th}$ tissue is equal to the dimension of the respective trailing (10) or leading (6) panels of the $n+1^{th}$ tissue. The length of the corner gap (20) can be equal to zero or have a positive value. Typically the length of the corner gap is less than about 1 mm, less than about 2 mm, less than about 5 mm, less than about 10 mm, or less than about 25 mm, for a stack of tissues of the invention—for example for wet-wipes. The corner gap length (that is measured along the length of the tissues) can be constant value throughout the stack. Alternatively the corner gap can vary throughout the stack. Preferably the length of the corner gap (20) is greater for the tissues closest to the dispensing orifice and smaller for the tissues further away from the dispensing orifice.

Figure 9:
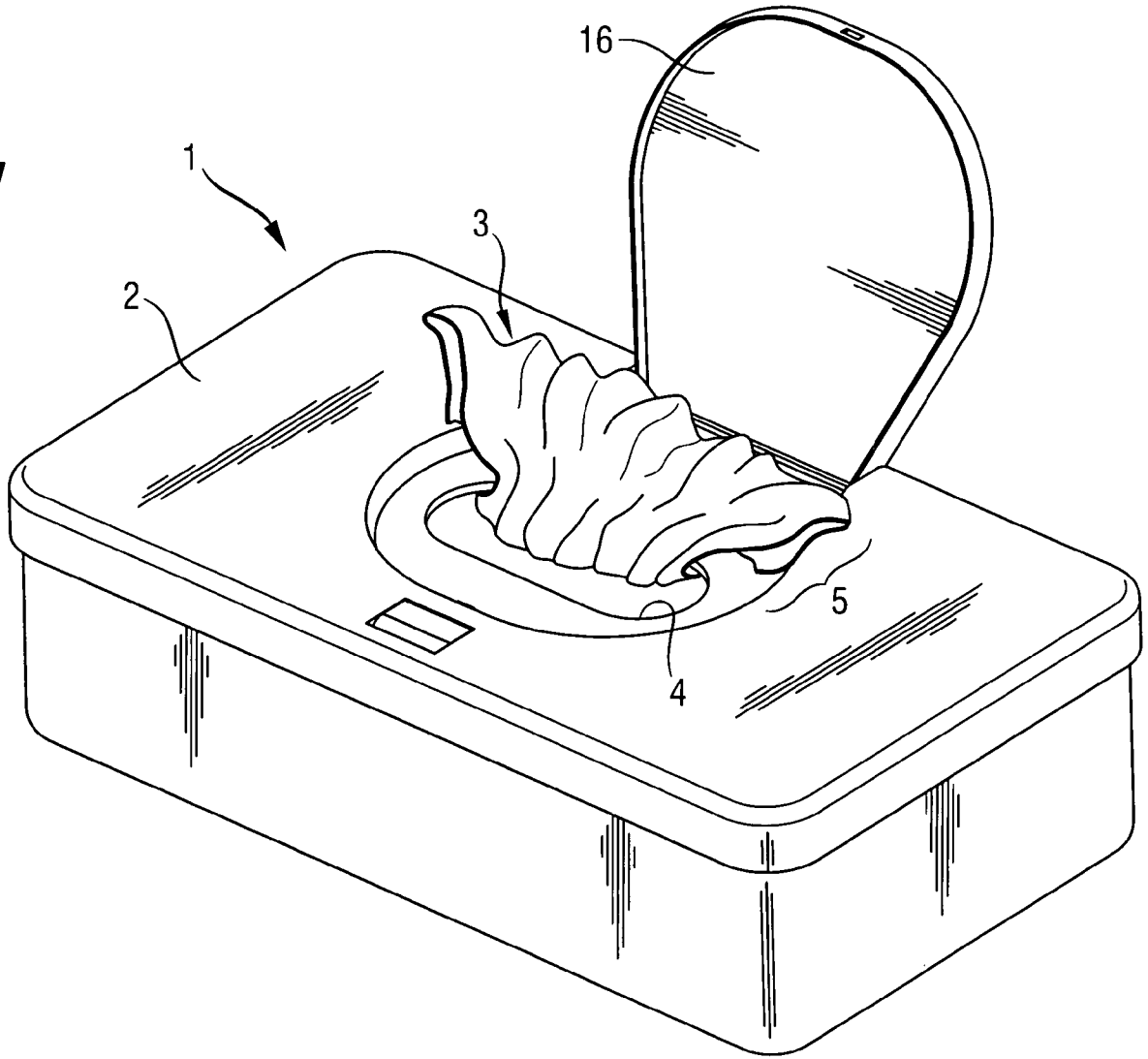
FIG. 9 is a perspective view of a pack of the invention, the external envelope being a hard walled container.

External envelope: Stacks of tissues are conventionally enclosed in an external envelope. The external envelop can serve as a protective envelope and/or a selling unit and/or a dispensing device. The external envelope can be made of a flexible film (for example polyethylene or polypropylene or mixture thereof) to a refill pouch or a flexible pack convenient for traveling. Alternatively, the external envelope can be made of a rigid material to form rigid envelopes, a rigid container or tub. Typical materials for rigid tubs comprise polymeric resins. Others can comprise metals, ceramics, wood or other rigid materials. FIG. 9 shows a typical rigid container for tissues (here being wet-wipes) according to the invention. The container can contain a stack of tissues according to the invention. The lid (16) can cover the dispensing orifice (4) in a resealable way and, hence, prevent the exposed leading portion of the first wipe from dry-out. FIG. 1 shows another typical pack of tissues (1) according to the invention: The external envelop (2) encloses a stack of tissues (13). In this case the external envelop (2) is a thin flexible polyethylene film enclosing the tissues (3) that are wet wipes and forming the pack (1).

Figure 10:
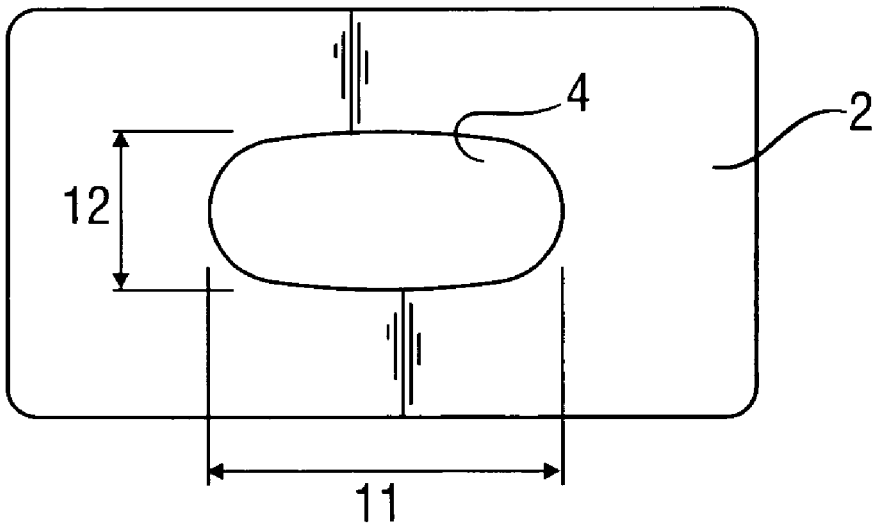
FIG. 10 is a dispensing opening applicable for a pack of the invention.

Dispensing orifice: External envelopes generally comprise a dispensing orifice (4) through which the enclosed tissues can be dispensed. Conventionally dispensing orifices (4) can have a variety of form and dimensions. FIG. 10 shows one conventional dispensing orifice (4) having an oval shape. Other shapes such as round, square, ovoid, triangular or rectangular shapes are possible. The dispensing orifices (4) are characterized by a length (11) and a width (12). The length (11) is the maximum dimension of the dispensing orifice (4) in a direction that is substantially parallel to the leading edge (14) of the tissues. The width (12) of the dispensing orifice (4) is the maximum dimension of the dispensing orifice (4) in a direction orthogonal to the length (11) of the dispensing orifices (4).

In this document, the distance of the dispensing orifice to the tissue is the distance measured orthogonally from the plane of the dispensing orifice, from its center, to the surface of the tissues (3) in the stack (13). In a typical pack, the distance measurement is also orthogonal to the general plane of the folded tissues in the stack (13). The terms "closer to" or "further away from the dispensing orifice" in regard to a tissue of the stack refers to the above distance measurement. The terms "top of stack" and "bottom of stack" are similarly used in regard to the position of the tissues in the stack relative to the dispensing orifice (The top of stack being closest to the dispensing orifice).

Figure 8:
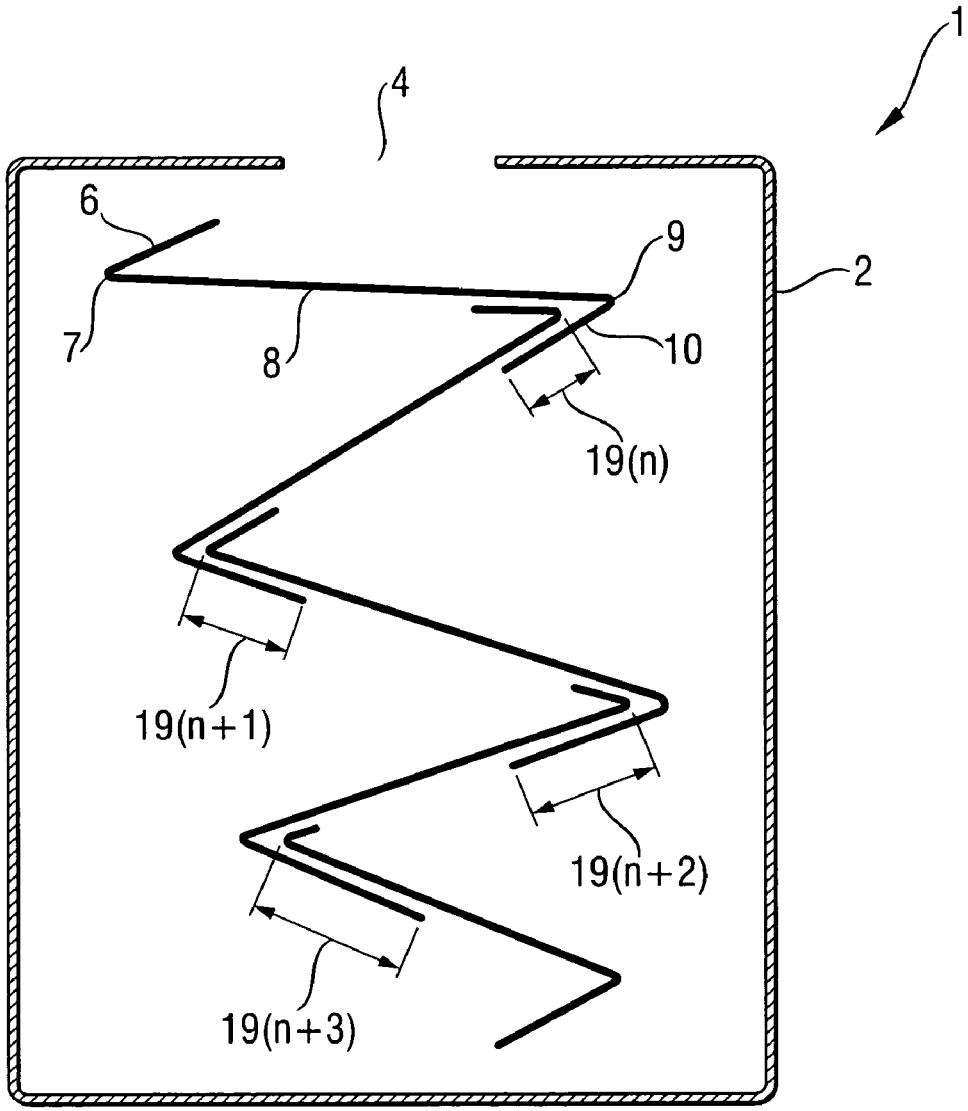
FIG. 8 is a schematic representation of a pack of tissues according to the invention.

The invention can be described in regard to FIG. 8: The pack (1) of multiple tissues (3) of the invention comprises an external envelop (2) and a stack (13) of tissues (1) that are interfolded such as to have a portion of the trailing (10) or central panel (8) of the $n^{th}$ tissue being (i) located under a portion of the $n+1^{th}$ tissue in said stack, and (ii) in contact with a portion of the $n+1^{th}$ tissue over an overlapping portion (19(*n*)) of the $n^{th}$ tissue. In the embodiment of FIG. 8, a portion of the trailing panel (10) of the first tissue is located under a portion of the second tissue.

According to the invention the surface area of the overlapping portion (19) of at least one tissue of the stack is different from the surface area of the overlapping portion of at least one other tissue of the stack. In the embodiment of FIG. 8, the surface area of the overlapping portion (19(n)) of the $n^{th}$ tissue is different from the surface area of the $n+1^{th}$ tissue—in this case it is of smaller surface area. Also in this embodiment all overlapping portions (19) of $n+1^{th}$ tissues are different from each other and in increasing order: surface area of overlapping portion (19(n)) is smaller than the surface area of the overlapping portion (19(n+1)). FIG. 8 exhibits: surface area of 19(n)<surface area of 19(n+1)<surface area of 19(n+2)<surface area of 19(n+3). The tissues of FIG. 8 have all the same width (see (17) of FIG. 3—the width of the tissue is not shown in FIG. 8 but can be seen in the perspective view of FIG. 3). Hence, the differences in the length of the overlapping portions (19) shown in FIG. 8 induce the differences in the surface areas.

Width and length of the overlapping portion (19) are defined in regard to and measured parallely to the width (17) and length (18) of the tissues (3). The surface area is measured or can be mathematically calculated from the width and length.

In one embodiment of the invention, the pack (1) of tissues (3) has the surface area of the overlapping portion (19(n+1)) of at least one $n+1^{th}$ tissue that is greater than the surface area of the overlapping portion (19(n)) of the $n^{th}$ tissue.

In one embodiment, the surface area of the overlapping portion (19) of the tissues (3) is smallest for the tissues closest (in the pack) to the dispensing orifice and greatest for the tissues further away from the dispensing orifice.

In yet another embodiment of the invention the pack (1) of interfolded tissues (3) is characterized in that the surface area of the overlapping portions (19) of the tissues (3) in average increases with the distance of the tissues in the pack from dispensing orifice (4). This means that any first group of tissues (3) taken from the stack (13) has an average surface area of their overlapping portions (19) that is equal or smaller than the average surface area of the overlapping portions (19) of a second group of tissues (3) that is taken from a part of the stack (13) in a position that is further away from the dispensing orifice than the first group. The average surface area of the overlapping portions (19) of a group of tissues is calculated by calculating the mathematical average of surface area of the overlapping portions (19) of each individual tissue of that group.

In another embodiment of the invention the pack (1) of tissues (3) comprises groups of consecutive tissues in the stack (13), wherein all tissues in each group have a substantially equal surface area of overlapping portions and wherein the surface area of the overlapping portions (19) in a group is different from the other groups. Preferably the groups all have different surface area of overlapping portions (19). In another embodiment the group having the greatest surface area of overlapping portions (19) is located in the stack (13) further way from the dispensing orifice compared to the other groups.

In yet another embodiment of the invention the pack (1) of tissues (3) the groups are positioned in the stack (13) in increasing order of surface area of overlapping portions (13): Groups with relatively greater surface area of overlapping portions (19) are respectively located further away from the dispensing orifice (4) compared to the other groups with relatively smaller surface area of overlapping portions (19).

In various embodiments of the invention, the stack (13) preferably comprises at least about 2, more preferably at least about 3, even more preferably at least about 4, and most preferably at least about 5 groups of tissues (1). In other embodiments the stack (13) comprises 2, 3, 4, 5, 10, 15 groups of tissues (1). Each group having a different surface area of overlapping portions (19), preferably positioned in the stack (13) in increasing order of surface area of overlapping portions (13). The groups can comprise 1, 2, 3, 5, 10, 15, 20, 30, 50 or more than 50 tissues. All groups can comprise an identical number of tissues. Alternatively the groups can comprise different number of tissues.

In one embodiment of the invention, the pack (1) of tissues (3) is characterized in that the surface area of the overlapping portion (19(n+1)) of any $n+1^{th}$ tissue is greater than the respective surface area of the overlapping portions (19(n) of any $n^{th}$ tissue.

The overlapping portion (19) has a width and a length. The width can substantially correspond to the width (17) of tissues (3) of the stack (1). In one embodiment the width overlapping portion (19) is substantially constant, and/or, in a further embodiment, is substantially equal to the width (17) of the tissue. Alternatively the width overlapping portions (19) can varies in the stack. In a further embodiment it can vary increasingly with the distance to the dispensing orifice (4).

It can be understood that the difference in the surface area of the overlapping portions (19) can be created by—for example: different width, different length, different shape of the leading edge (14) and/or trailing edge (15) of the tissues (3), or by combination thereof.

In one embodiment the width (17) the tissues (3) and of the width overlapping portion (19) are substantially equal and are constant for all tissues (3) in the stack (13). This is for example the most typical arrangement of a stack of tissue or wet wipes that have all same dimensions. In this case, the variation of surface area of the overlapping portion (19) is provided by a variable length of overlapping portions (19).

In one embodiment of the invention the pack (1) of tissues (3), the surface area of the overlapping portions (19) varies in the stack (13) in a linear manner, i.e. following a linear mathematical equation. In yet other embodiments, the surface area of the overlapping portions (19), and/or the length of overlapping portions (19) linearly increase as a function of the distance of the tissue (3) to the dispensing orifice (4). In yet other embodiment, the surface area and/or the length of overlapping portions (19) vary in a parabolic, logarithmic, or exponential manner, or any combination thereof, i.e. following a respectively parabolic, logarithmic, or exponential mathematical function.

Together or independently of the variation of the surface area of the overlapping portions (19), the pack (1) of the invention can also exhibit a variation in the surface area and/or the length of the trailing panels (10). The same variations that have been described for the surface area of the overlapping portions (19) can also apply to the variation of the surface area and/or the length of the trailing panels (10). The length and width of the panels are defined in regard and measured parallely to the length and width of the tissues.

In one embodiment, the trailing panels (10) have a width substantially corresponding to the width of the tissues (3) of the stack (1) and a variable length that varies along said stack, preferably increasing with the distance to the dispensing orifice (4). In one embodiment, the length of the trailing panels (10) is smallest toward the dispensing orifice.

In one embodiment the length of the overlapping portions of the $n^{th}$ tissues (19) can be between about 100 mm and about 2 mm, between about 50 mm and about 10 mm, or between about 30 mm and about 15 mm. In one embodiment the length of the overlapping portions of the $n^{th}$ tissues (19) in a particular stack of the invention varies between about 2 mm at the top of the stack and about 70 mm at the bottom of the stack, between about 5 mm at the top of the stack and about 60 mm at the bottom of the stack, between about 10 mm at the top of the stack and about 50 mm at the bottom of the stack or between about 15 mm at the top of the stack and about 32 mm at the bottom of the stack.

To induce proper lift the next tissue in the stack, the surface area of overlapping portions of the $n^{th}$ tissues (19) can be equal or more than about 1 $cm^2$, equal or more than about 10 $cm^2$, equal or more than about 200 $cm^2$ pending on the size of the tissue and of its adhesive properties. To prevent undesired adhesion of the tissues, it can be less than about 500 $cm^2$, less than about 100 $cm^2$, less than about 50 $cm^2$ or less than about 10 $cm^2$. The upper size of the surface area of overlapping portions (19) is related by the size of the tissue and the size of the panels, as well as to some desired dispensing properties. The surface area of overlapping portions of the $n^{th}$ tissues (19) can vary in a particular stack between about 2 $cm^2$ and about 200 $cm^2$, between about 5 $cm^2$ and about 100 $cm^2$ or between about 15 $cm^2$ and about 40 $cm^2$.

In one embodiment of the invention, the tissues (3) are wipes, preferably a wet wipes comprising a softening lotion. The tissues of the invention can be absorbing tissues or non absorbing tissues. In other embodiments, the tissues (3) are paper tissues, preferably absorbing paper tissues, cosmetic tissues for facial use, cleaning tissues, surface-treating tissues, paper towels, toilet papers, bath tissues or paper handkerchiefs. Preferably the tissues and/or the wipes have a length of between about 5 cm and about 100 cm and a width between about 5 cm and about 50 cm, most preferably a length of between about 10 cm and about 20 cm and a width of between about 7 cm and about 15 cm. The thickness of the tissues can be of any value suitable for the intended usage and enabling dispensing out of the pack (1). Typically the tissues of the invention have a thickness of less than about 20 mm, less than about 10 mm, less than about 5 mm, less than about 2 mm or less than about 1 mm.

In one embodiment of the invention, the length (11) of the dispensing orifice (4) is between about 10% and about 80% of the width of the tissues. These values have been proven to best combine with the pack of the invention.

In a yet different embodiment of the invention, the corner gap (20) has a length that varies in the stack. Preferably the corner gap (20) of a $n^{th}$ tissue has a greater length than a corner gap of a $n+1^{th}$, $n+2^{th}$, $n+3^{th}$ or $n+x^{th}$ tissue of the stack (13) (x being any integer wherein $n+x \leqq$ number of tissues in the stack). Most preferably, the corner gaps (20) are in average of greater length for the tissues that are located closer to the dispensing orifice (4). The corner gaps (20) can be of zero length for the tissues the further away from the dispensing orifice (4).

It is to be understood that corner gaps (20) length, surface area of the overlapping portions (13), length of the overlapping portions (19), panel's lengths and all interrelated and variations in one of them may induce variations in one or more of the others.

In one embodiment of the invention, the length (11) of the dispensing orifice is between about 5 mm and about 120 mm or between about 20 mm and about 100 mm. The length (11) can alternatively be between about 30 mm and about 75 mm. In one embodiment, the length (11) of the dispensing orifice is about 75 mm and the width (17) of the tissues is about 10 mm.

In one embodiment of the invention the width (17) of the tissues is between about 50 mm and about 150 mm, alternatively between about 60 mm and about 130 mm or between about 80 mm and about 120 mm. In an embodiment the width (17) of the tissues is about 110 mm.

In one embodiment of the invention, the length (11) of the dispensing orifice is about 20% to about 70% of the width of the tissues. Alternatively, the length (11) of the dispensing orifice is about 30% to about 50% of the width (17) of the tissues. Without being bound by the theory, it is believed that within the above range, the friction between the edges of the wipe and the edges of the dispensing orifices during dispensing induces a relatively high adhesion between the first and the second wipe. This force a portion of the leading panel (6*b*) and a portion of the central panel (8*b*) of the second tissue to be lifted such as to protrude from the dispensing orifice (4), forming a dual layer exposed leading portion (5). If the length (11) of the dispensing orifice is relatively too large in comparison to the width (17) of the tissues, then the low friction of the tissue along the edges of the dispensing orifice induces a complete unfolding of the tissue. The same occurs when the dispensing orifice (4) is too narrow in comparison to the width (17) of the tissues, caused by too high friction. Additionally, it is believed that a dispensing orifice within above range induces less occurrence of "fall-back" (leading panel of a second wipe falling back into the external envelope and not protruding from the dispensing orifice—this is inconvenient for dispensing the wipes). The adhesion forces between the tissues also play a role in the above interactions.

In one embodiment of the invention the length of the overlap (19) between two consecutive tissues is between 15 mm and 30 mm for a tissue length (18) of 150 mm, and the corner gap (20) between 3 and 5 mm.

In the below embodiments, the tissues are wipes. The same as described below has been shown to be applicable in the context of the present invention for tissues in general (and not only for wipes): In certain embodiments of the invention the wipes have a corner gap (20) that is a constant throughout the stack. In other embodiments, it has been observed that a variable corner gap (20), trailing panel length (10) and thus the resulting overlap (19) can induce some dispensing advantages. For example, a corner gap (20) that is between about 8 and about 10 mm for the first 10 wipes of a stack of 48 and that is then between about 3 and about 4 mm for rest of the wipes in the stack has been shown to provide advantages for the dispensing (i.e. more uniform and reliable dispensing). This was observed for a stack of wipes in a flexible film pouch, having the following dimensions: wipes length about 150 mm, wipes width about 110 mm, leading panel length about 45 mm (first ten wipes), leading panel length about 40 mm (wipes # 11 to 48), central panel length about 80 mm, trailing panel length about 25 mm (first ten wipes), trailing panel length about 30 mm (wipes #11 to 48), stack dimension, (height about 44 mm, width about 90 mm, length about 110 mm) dispensing orifice dimension about 30 mm in diameter. The variable corner gap and trailing panel length can vary step by step throughout the height of the stack or can continuously (e.g. linearly) vary between two extreme values. This has also been shown when the variable corner gap and trailing panel length is combined with the present invention.

Figure 2:
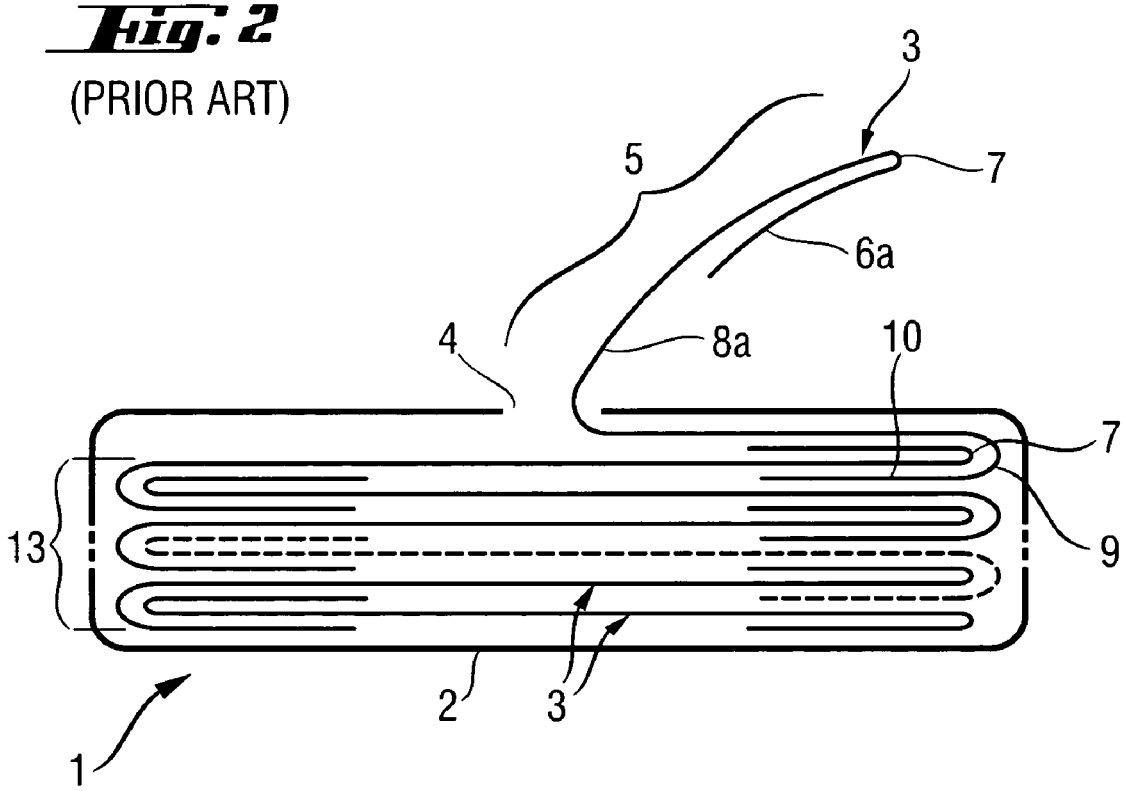
Fig. 2 (PRIOR ART)
FIG. 2 is a schematic section of a pack of FIG. 1 through the line A-B showing the tissues interfolding configuration.
Figure 3:
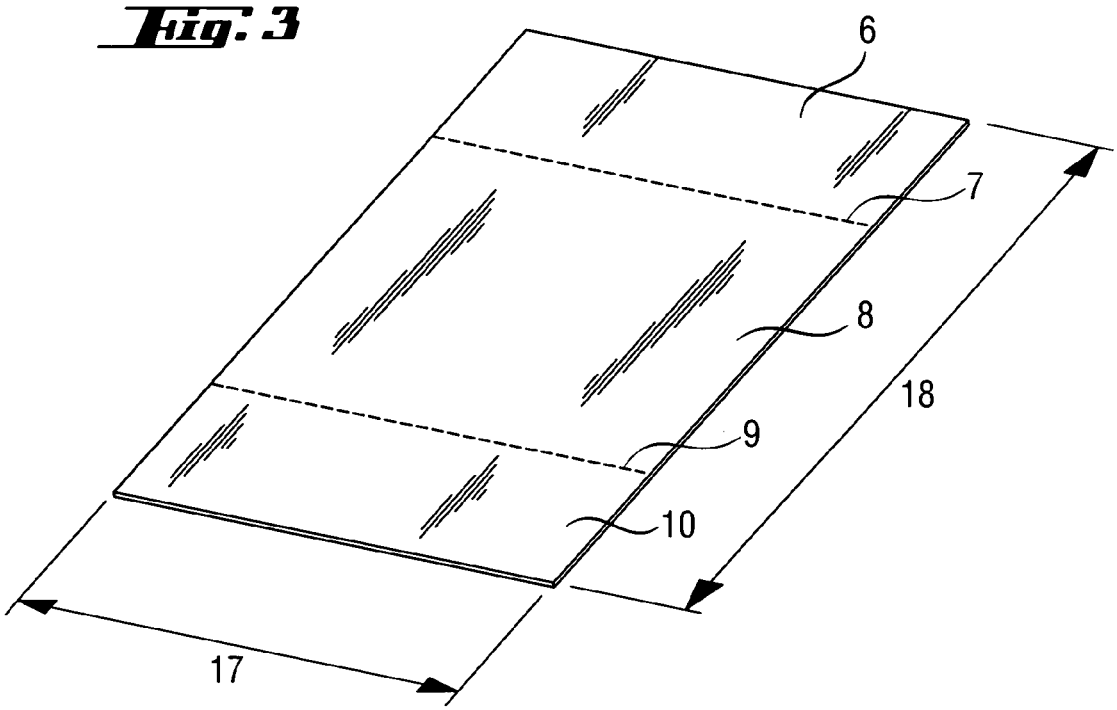
FIG. 3 is a schematic perspective view of a tissue as used by the invention.

It is to be noted that all the figures are only schematic representations. In particular in FIGS. 1, 2 and 8, the distance between the exposed portions of the leading panel 6*a* and of the central panel have been exaggerated. As detailed above and in the claims, these portions may be in contact with each other.

In one embodiment of the invention, the separation force between the tissues is between about 0.05 N and about 5 N or between about 0.1 N and about 2 N. In a particular embodiment, the separation force is about 1.15 N. The separation force is measured as described hereafter.

Process: The pack of the invention can be made with any conventional folding equipment to fold, stack and pack the tissues, in so far the equipment allows adjusting separately the surface area of at least one overlapping portion (19). Indeed the process of the invention must allow at least one overlapping portion (19) to be different from the other overlapping portions. In one embodiment, the process of the invention uses groups of folding stations, (a group comprising one or more folding stations). In one embodiment the groups of folding stations are adjusted or set-up separately so as to create overlapping portions (19) that are of larger surface area for the tissues that are positioned relatively further from the dispensing orifice (4) of the pack (1). In a further embodiment, separate individual folding stations are used to fold each tissue of the stack, and the process comprises the steps of setting-up the separate individual folding stations such as to deliver the desired surface area of the overlapping portion (19) of the tissues. The folding stations can act on the width or the length of the panels (6, 7, and 10) of the tissues (3). In yet another embodiment the folding stations are replaced or complemented by one or more cutting sub-station(s) and the process includes the step of cutting in the width of the tissues (3) to provide variable overlapping portions (19).

Theoretical principle of the invention: Without desiring to be bound by theory, it is believed that the invention is linked to the variation of the surface area of the overlapping portion (19) for the tissues (3) in the stack (13): This principle—in a reducing way that does not encompass the full scope of the invention—, is referred to as "variable overlaps in a stack". In any pack of tissues, the dispensing of some tissues out the pack leaves behind an empty space above the stack of tissues. Gravity induces the remaining tissues to stay toward the bottom of the external envelop, leaving between the first tissue of the stack and the dispensing orifice a so-called "head space". The head-space increases when the height of the stack of tissue is reduced by the dispensing of some tissues out of the pack. That variable head-space is one cause of the dispensing failures previously described. The principle of "variable overlap" is an attempt to compensate the variation of head-space by a variation of the adhesion force between the tissues (the adhesion is linked to the overlap surface area). For example the invention can be understood in the following manner: In order for the very first tissue of the stack to lift a portion of the interfolded second tissue of the stack, a first degree of friction/adhesion between the tissues is necessary. That friction/adhesion between the tissues is closely related to surface area of the overlapping portions (19), or to the length of the overlapping portions (19), to the length of the trailing panels (10) and/or to the length of the corner gap (20). When some or most of the tissues have been removed from the stack, the increased head-space above the tissues requires a different balance of friction/adhesion between the tissues, as the tissues must be lifted to the dispensing orifice over an increased distance. The "variable overlap" of the invention then responds to the need for a different friction/adhesion between the tissues. In one embodiment, the additional surface area of overlap provides an additional adhesion between the tissues that, in turn, allows the tissues to be more consistently lifted over the increased head-space to the dispensing orifice.

The benefits of the invention have been observed for more consistent dispensing, reduced "chaining", reduced "fall-back", and optimum exposed leading edge (5) that can related to reduce dry-out for stacks of wet-tissues.

Example: In the example below, the tissues are wet wipes conventionally made of a 40% pulp/60% Lyocell fibers spunlace substrate having a basis weigh of 60 g/m$^2$, that is loaded with a softening lotion comprising Aqua, Propylene Glycol, Phenoxyethanol, PEG-40 Hydrogenated Castor Oil, Trilaureth-4 Phosphate, Methylparaben, Sodium Phosphate, Xanthan Gum, Disodium EDTA, Bis-PEG/PPG-16/16 PEG/PPG-16/16 Dimethicone, Ethylparaben, Propylparaben, Perfume, Caprylic/Capric Triglyceride, Hydroxycitronellal, Amyl Cinnamal. The external envelop is a polypropylene/polyethylene laminate, thickness 73 μm, flexible film with a dispensing orifice having a rectangular shape of 35 mm×45 mm. The wipes were interfolded and had a general Z-folding configuration as illustrated in FIGS. 4 and 8. The wipes dimensions are: length 110 mm×150 mm width, caliper 0.5 mm. Table 1 shows the folding configuration of the wipes in the stack: wipes 1 (the closest to the dispensing orifice) to 8 had a length of the overlapping portion (19) of 15 mm where wipes 41 to 48 (last wipe in the stack) has a length of the overlapping portion (19) of 32 mm.

TABLE 1 folding configuration

| Wipes position in stack (#1 is closest to dispensing orifice) | Length of Leading panel [mm] | Length of Trailing panel [mm] | Length of central panel [mm] | Corner gap [mm] | Length of overlapping portion [mm] | Surface area of overlapping portion (cm$^2$) |
|---|---|---|---|---|---|---|
| 1 to 8 | 45 | 25 | 80 | 10 | 15 | 16.5 |
| 9 to 10 | 40 | 30 | 80 | 10 | 20 | 22 |
| 11 to 12 | 40 | 30 | 80 | 8 | 22 | 24.2 |
| 13 to 14 | 40 | 30 | 80 | 6 | 24 | 26.4 |
| 15 to 16 | 40 | 30 | 80 | 4 | 26 | 28.6 |
| 17 to 18 | 40 | 30 | 80 | 2 | 28 | 30.8 |
| 19 to 40 | 40 | 30 | 80 | 0 | 30 | 33 |
| 41 to 48 | 38 | 32 | 80 | 0 | 32 | 35.2 |

In the above example the dispensing failure events were reduced as follows, compared to a prior art pack of wipes having a constant surface area of the overlapping portions (all other parameters being the same, namely lengths of: leading panel 40 mm, trailing panel 30 mm, center panel 80 mm, corner gap 8 mm):

Chaining events: reduced from 0.2 (prior art) to 0.1 (invention) in average per stack of 48 wipes.

Fall-back events: reduced from 3.5 (prior art) to 1.0 (invention) in average per stack of 48 wipes.

Short dual-layer leading edge: increased from 60% (prior art) to 95% (invention) in average per stack of 48 wipes. The "short dual layer leading edge" property is a desired property related to the dispensing of tissues (or wipes) wherein the tissues (or wipes) exhibit, upon dispensing, a part of the leading panel folded on itself or on the central panel. This induces a better grip and a more convenient dispensing for the user, while reducing the dry-out of the stack of tissues.

Measurement method for Separation force: For measuring separation forces, twenty tissues are unfolded and placed flat on top of each other such as to overlap the leading panels of the tissues; the dimension of the overlapping zone is 12 cm. When a lotion is present on the tissues the sides of the tissues comprising the lotion are overlapped. The stack of tissues is compressed with 40 kg for 15 seconds over a surface of 25 cm×25 cm or to an equivalent pressure. A compression stand is used to apply the pressure (PSP-Lockwood Green Pressure Device, manufacturer: PSP-Lockwood Greene GmbH, Germany—used according to manufacturer instructions). Samples are stored prior to separation force measurement for 72 hours+/−4 hours at a constant temperature (25° C.) and constant relative humidity, (50% relative humidity).

The reported separation force is the maximum (peak) force observed during the vertical separation of two consecutive wipes in the stack (One pair of wipes is removed from the stack and fixed in the tensile tester for measurement). The separation force is measured with a tensile tester (ZWICK Roell Tensile Tester, type BTC-FR2, Zwick GmbH & Co. KG, Ulm, Germany). The tester is used according to manufacturer instructions. The operation parameters are as follows: start distance clamps: 270 mm, clamps with flat rubber surface, width 60 mm, pre-force: 0.05 N, pull-speed: 300 mm/min, load-cell: 10-20 N with resolution of 0.01 N.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

The dimensions and/or values disclosed herein are not to be understood as being strictly limited to the exact dimension and/or numerical value recited. Instead, unless otherwise specified, each such dimension and/or numerical value is intended to mean both the recited dimension and/or numerical value and a functionally equivalent range surrounding that dimension and/or numerical value. For example, a dimension disclosed as "40 mm" is intended to mean "about 40 mm".

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A pack of tissues comprising multiple tissues arranged in a stack and an external envelope comprising:

a dispensing orifice and enclosing said stack; said tissues being folded such as to comprise a leading panel, a trailing panel, a central panel, a leading fold and a trailing fold, wherein said leading fold separates said leading panel from said central panel and said trailing fold separates said trailing panel from said central panel, said stack having a $n^{th}$ tissue and a n+1 tissue, said n+1 tissue being positioned next to said $n^{th}$ tissue in said stack and further away in the stack from said dispensing orifice, wherein n is an integer having any value between 1 and 1 less than the number of tissues in said stack, and said tissues are interfolded such as to have a portion of said trailing or central panel of said $n^{th}$ tissue being (i) located under a portion of said n+1 tissue in said stack such that the $n^{th}$ and n+1 tissue each have an overlapping portion; and (ii) in contact with said portion of said n+1 tissue over an overlapping portion of said $n^{th}$ tissue such that the surface area of said overlapping portion of at least one n+1 tissue is greater than the surface area of said overlapping portion of said nth tissue; and wherein the pack further comprises a plurality of corner gaps, such that the leading and trailing folds of two consecutive tissues do not touch each other, and that the length of the corner gap of at least one $n^{th}$ tissue is greater than the length of the corner gap of the n+1 tissue.

2. The pack of tissues of claim 1 characterized in that the surface area of said overlapping portions of said tissues in average increases with the distance of said tissues from said dispensing orifice.

3. The pack of tissues of claim 1 wherein said stack comprises groups of consecutive tissues in said stack, wherein all tissues in each group have a substantially equal surface area of said overlapping portions, characterized in that the surface area of said overlapping portions in a group is different from the other groups.

4. The pack of tissues of claim 3 wherein said stack comprises at least 3 of said groups of tissues.

5. The pack of tissues of claim 1 wherein the surface area of said overlapping portions varies in said stack in a linear manner.

6. The pack of tissues of claim 1 wherein said tissue is a wipe.

7. The pack of tissues of claim 6 wherein said wipe is a wet wipe.

8. The pack of tissues of claim 1 wherein said tissue is a paper towel.

9. The pack of tissues of claim 1 wherein said tissues have a width and said dispensing orifice having a length, said length being orientated parallel to said width of said tissues and said length of said dispensing orifice is between about 10% and about 80% of said width of said tissues.

10. The pack of tissues of claim 1 wherein the corner gap is less than about 25 mm.

11. The pack of tissues of claim 10 wherein the corner gap is less than about 10 mm.

12. The pack of tissues of claim 1 wherein said surface area of said overlapping portion of said n+1 and $n^{th}$ tissues vary as a function selected from a group consisting of: parabolic functions, logarithmic functions, exponential functions, and combinations thereof.

13. The pack of tissues of claim 1 wherein said tissues are V-folded.

14. The pack of tissues of claim 1 wherein said tissues are Z-folded.

15. The pack of tissues of claim 1 wherein said tissues are C-folded.

* * * * *